US011009255B2

(12) United States Patent
Morris

(10) Patent No.: US 11,009,255 B2
(45) Date of Patent: May 18, 2021

(54) SUPPLY AIR PLENUM

(71) Applicant: Donald Morris, New Orleans, LA (US)

(72) Inventor: Donald Morris, New Orleans, LA (US)

( * ) Notice: Subject to any disclaimer, the term of this patent is extended or adjusted under 35 U.S.C. 154(b) by 168 days.

(21) Appl. No.: 16/122,244

(22) Filed: Sep. 5, 2018

(65) Prior Publication Data

US 2020/0072491 A1 Mar. 5, 2020

(51) Int. Cl.
*F24F 13/02* (2006.01)

(52) U.S. Cl.
CPC ..... *F24F 13/0209* (2013.01)

(58) Field of Classification Search
CPC ..... F24F 13/0209; F24F 13/0218
USPC ..... 454/339, 370
See application file for complete search history.

(56) References Cited

U.S. PATENT DOCUMENTS 2,955,342 A * 10/1960 Litzler ..... D06C 7/00 26/106
5,062,280 A 11/1991 Martin, Sr.
5,151,063 A 9/1992 Tanaka
5,207,615 A 5/1993 Edmisten
5,516,329 A * 5/1996 Dunn ..... B08B 15/002 454/64
D397,202 S 8/1998 Saar
6,231,704 B1 * 5/2001 Carpinetti ..... F16L 9/003 138/149
7,410,416 B2 8/2008 Fettkether
9,242,529 B2 * 1/2016 Liao ..... B60H 1/244
2004/0130154 A1 7/2004 Stepp
2008/0308674 A1 * 12/2008 Frantz ..... B29C 66/4322 244/118.5
2011/0237175 A1 9/2011 Buseyne
2012/0202415 A1 * 8/2012 Rudd ..... F24F 7/06 454/338

FOREIGN PATENT DOCUMENTS

WO WO2007110505 10/2007

* cited by examiner

*Primary Examiner* — Kenneth J Hansen
*Assistant Examiner* — Dana K Tighe

(57) ABSTRACT

A supply air plenum for more efficient heating and cooling includes a shell that defines an interior space. The shell comprises a first section and a second section. The first section has a bottom that is open and is configured to couple to an air handler so that the interior space is in fluidic communication with the air handler. The second section is coupled to and protrudes from a first side of the first section. A plurality of tubes is coupled to and extends from the second section of the shell. Each tube is configured to couple to a respective return conduit of an air supply system of a structure. The tubes are configured for intake of air from the structure through the interior space to the air handler.

12 Claims, 4 Drawing Sheets

SUPPLY AIR PLENUM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to plenums and more particularly pertains to a new plenum for more efficient heating and cooling.

BRIEF SUMMARY OF THE INVENTION

An embodiment of the disclosure meets the needs presented above by generally comprising a shell that defines an interior space. The shell comprises a first section and a second section. The first section has a bottom that is open and is configured to couple to an air handler so that the interior space is in fluidic communication with the air handler. The second section is coupled to and protrudes from a first side of the first section. A plurality of tubes is coupled to and extends from the second section of the shell. Each tube is configured to couple to a respective return conduit of an air supply system of a structure. The tubes are configured for intake of air from the structure through the interior space to the air handler.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
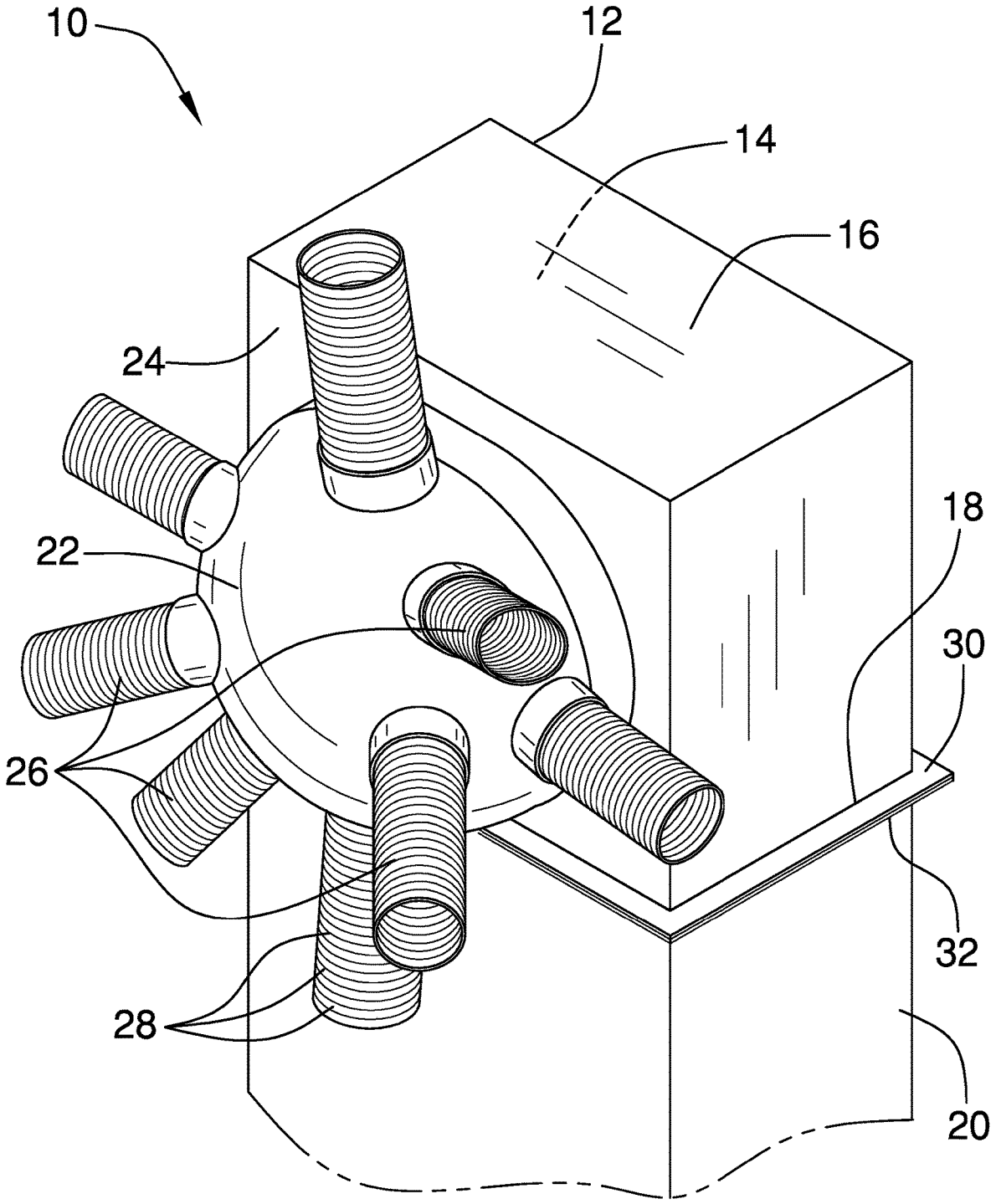
FIG. 1 is an isometric perspective view of a supply air plenum according to an embodiment of the disclosure.

With reference now to the drawings, and in particular to FIGS. 1 through 4 thereof, a new plenum embodying the principles and concepts of an embodiment of the disclosure and generally designated by the reference numeral 10 will be described.

As best illustrated in FIGS. 1 through 4, the supply air plenum 10 generally comprises a shell 12 that defines an interior space 14. The shell 12 comprises a first section 16, which has a bottom 18 that is open. The first section 16 is configured to couple to an air handler 20 so that the interior space 14 is in fluidic communication with the air handler 20. The first section 16 is substantially rectangularly box shaped. The shell 12 also comprises a second section 22. The second section 22 is coupled to and protrudes from a first side 24 of the first section 16. The second section 22 is substantially hemispherically shaped, as shown in FIG. 1.

A plurality of tubes 26 is coupled to and extends from the second section 22 of the shell 12, as shown in FIG. 1. Each tube 26 is configured to couple to a respective return conduit of an air supply system of a structure. The tubes 26 are configured for intake of air from the structure through the interior space 14 to the air handler 20. Each tube 26 comprises a plurality of pleats 28 so that the tube 26 is selectively bendable. The pleats 28 allows each tube 26 to be positioned optimally for coupling to the respective return conduit. The plurality of tubes 26 comprises from four to twelve tubes 26. The plurality of tubes 26 comprises from six to ten tubes 26. The plurality of tubes 26 comprises eight tubes 26.

Figure 3:
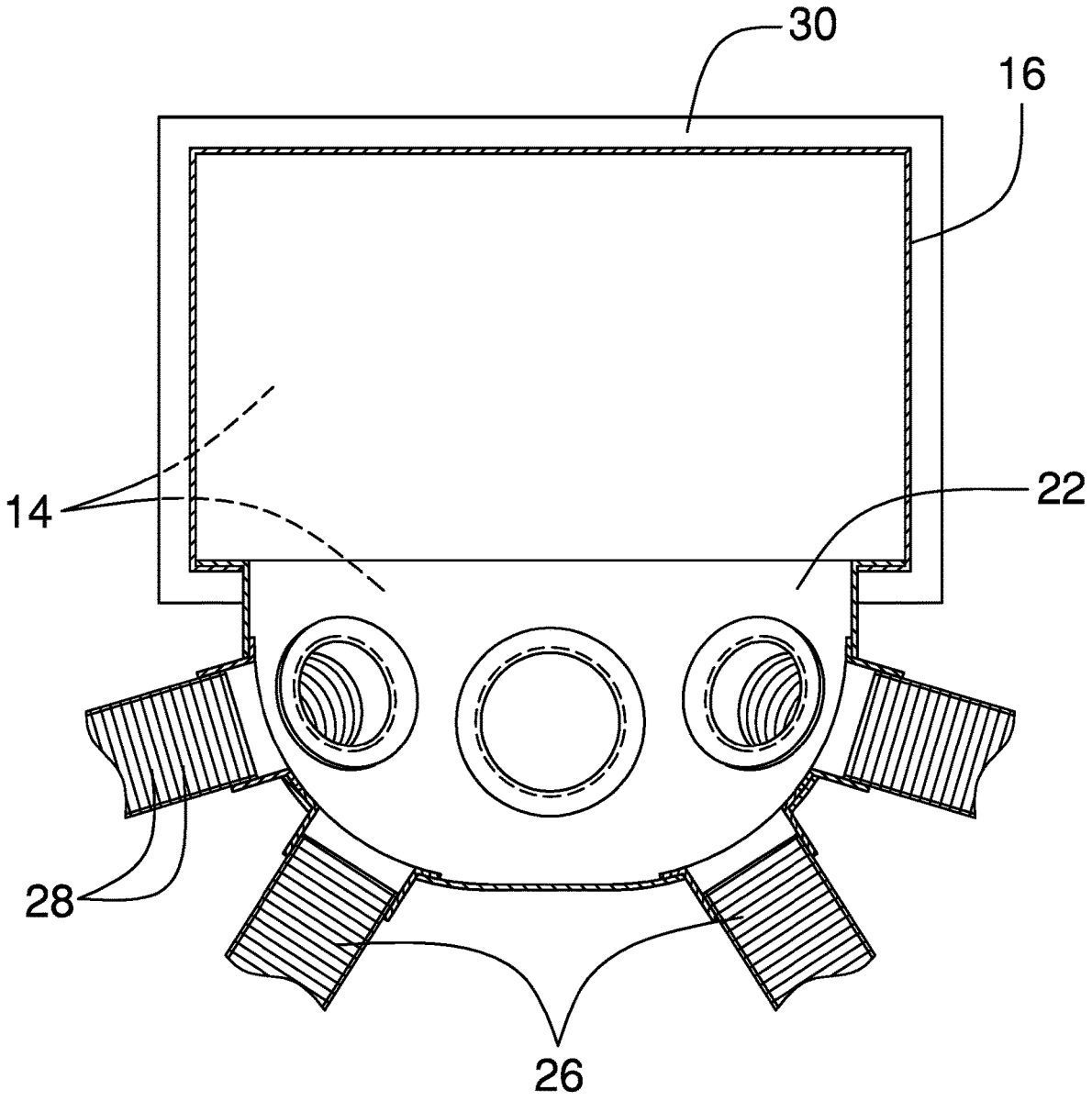
FIG. 3 is a cross-sectional view of an embodiment of the disclosure.
Figure 4:
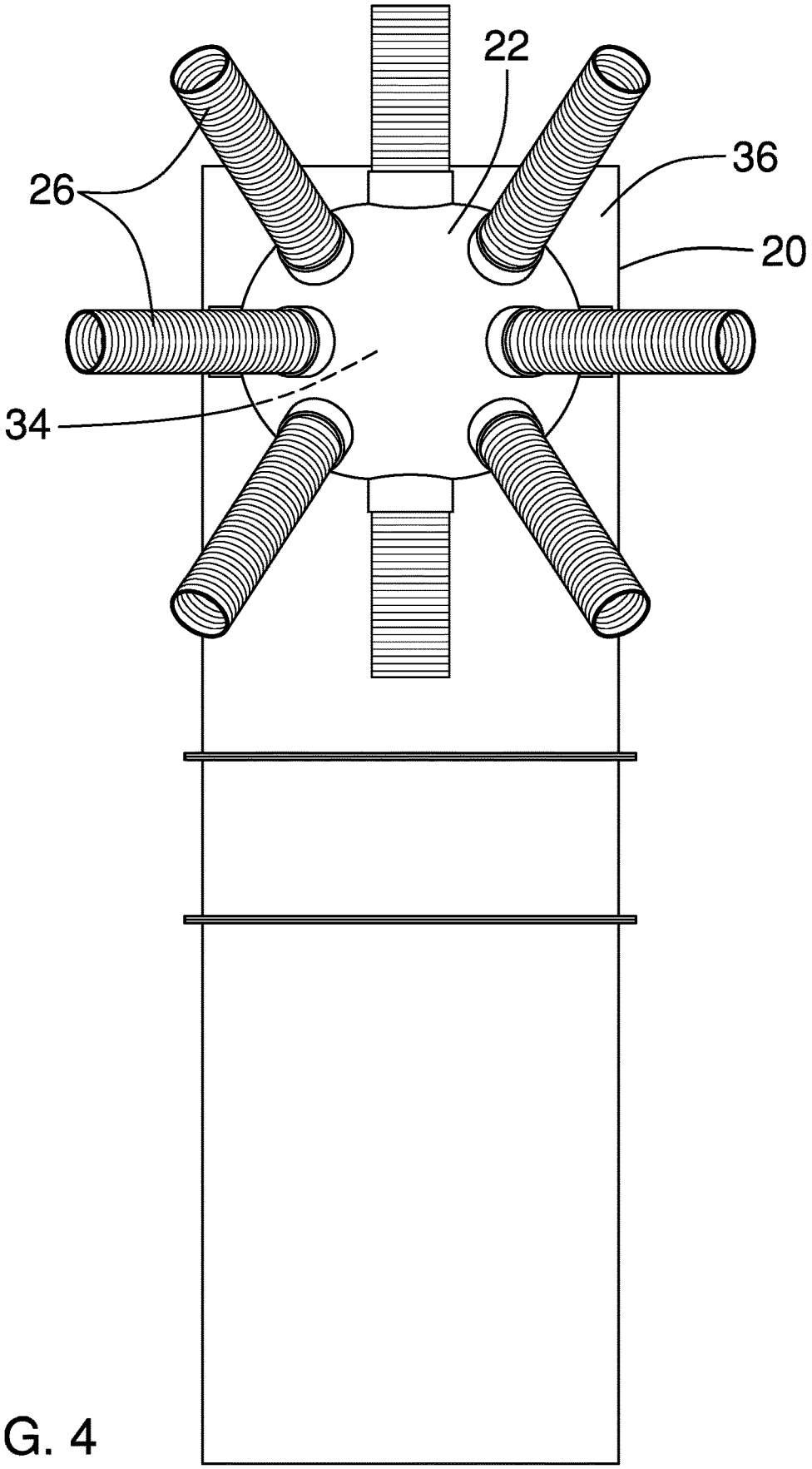
FIG. 4 is an in-use view of an embodiment of the disclosure.

A flange 30 is coupled to and extends perpendicularly from the bottom 18 of the first section 16, as shown in FIG. 3. The flange 30 is configured to mate with a corresponding flange 32 on the air handler 20 to couple the shell 12 to the air handler 20. In one embodiment of the invention, as shown in FIG. 4, the second section 22 is configured to couple directly to the air handler 20 without using the first section 16 of the shell 12. In this embodiment, the second section 22 would be coupled to the air handler 20 to cover a substantially circular hole 34 that is positioned in a wall 36 of the air handler 20.

Figure 2:
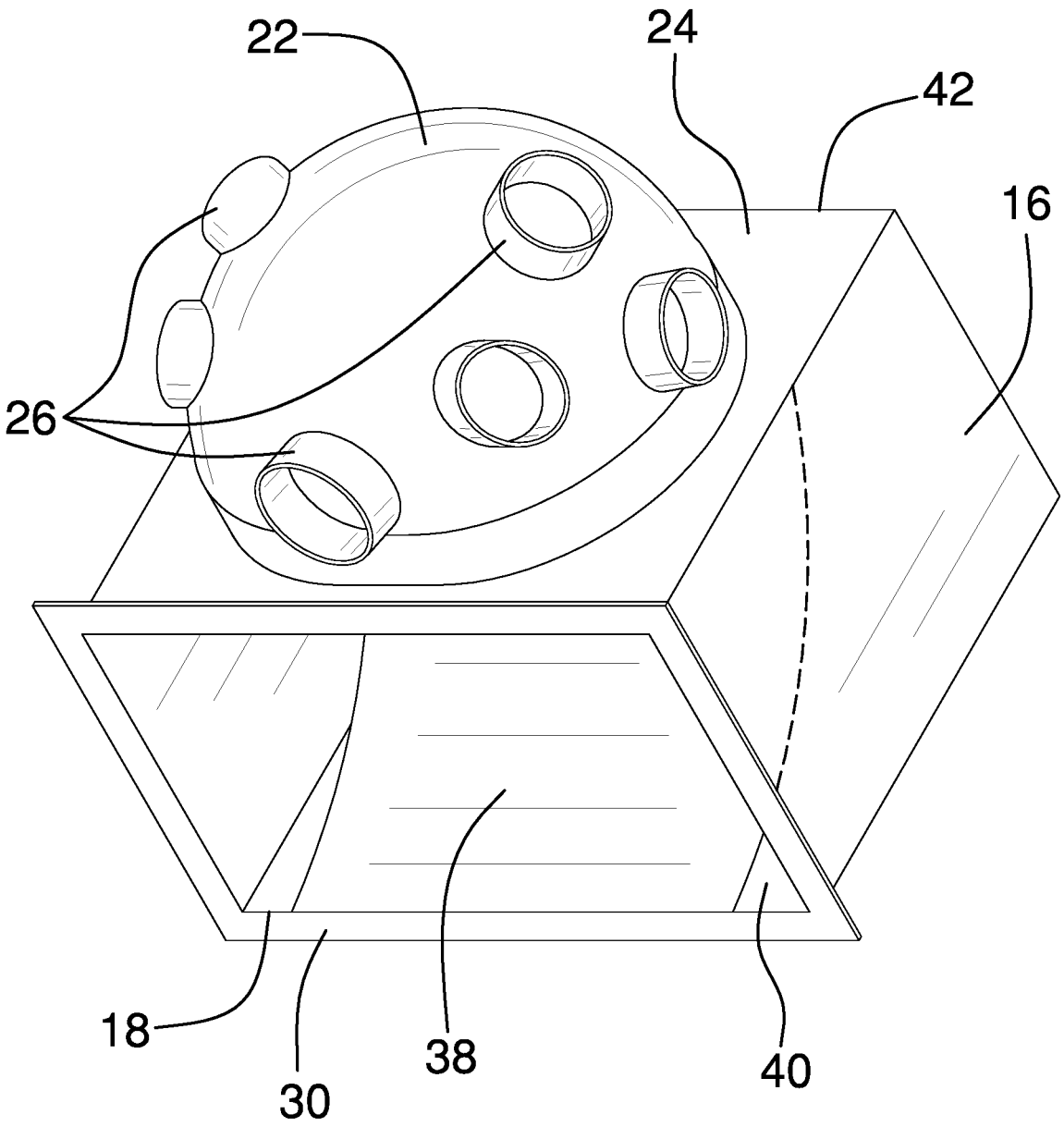
FIG. 2 is an isometric perspective view of an embodiment of the disclosure.

A plate 38 is coupled to the first section 16 and is positioned in the interior space 14, as shown in FIG. 2. The plate 38 extends arcuately between the first side 24 and a second side 40 of the first section 16 so that the plate 38 extends from proximate to the bottom 18 to proximate to a top 42 of the first section 16. The plate 38 is configured to direct the air entering through the tubes 26 into the interior space 14 through the bottom 18 to the air handler 20.

In use, the first section 16 is coupled to an air handler 20. Each tube 26 is coupled to the respective return conduit of the air supply system of the structure.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A supply air plenum comprising:

a shell defining an interior space, the shell comprising:

a first section having a bottom, the bottom being open wherein the first section is configured for coupling to an air handler such that the interior space is in fluidic communication with the air handler, and a second section, the second section being coupled to and protruding from a first side of the first section, the second section being hemispherically shaped; and a plurality of tubes coupled to and extending from the second section of the shell wherein each tube is configured for coupling to a respective return conduit of an air supply system of a structure wherein the plurality of tubes are configured for intaking air from the structure through the interior space to the air handler.

2. The plenum of claim 1, further including the second section being directly couplable to the air handler.

3. The plenum of claim 1, further including the first section being substantially rectangularly box shaped.

4. The plenum of claim 3, further including a plate coupled to the first section and positioned in the interior space, the plate extending arcuately between the first side and a second side of the first section such that the plate extends from proximate to the bottom to proximate to a top of the first section wherein the plate is configured for directing the air entering through the tubes into the interior space through the bottom to the air handler.

5. The plenum of claim 1, further including each tube comprising a plurality of pleats such that the tube is selectively bendable.

6. The plenum of claim 1, further including the plurality of tubes comprising from four to twelve tubes.

7. The plenum of claim 6, further including the plurality of tubes comprising from six to ten tubes.

8. The plenum of claim 7, further including the plurality of tubes comprising eight tubes.

9. The plenum of claim 1, further including a flange coupled to and extending perpendicularly from the bottom of the first section wherein the flange is configured for mating with a corresponding flange on the air handler for coupling the shell to the air handler.

10. An air handler and supply air plenum combination comprising:

the air handler; and the supply air plenum comprising a shell defining an interior space, the shell comprising:

a first section having a bottom, the bottom being open, the first section being coupled by the bottom to the air handler such that the interior space is in fluidic communication with the air handler, and a second section, the second section being coupled to and protruding from a first side of the first section, the second section being hemispherically shaped; and a plurality of tubes coupled to and extending from the second section of the shell wherein each tube is configured for coupling to a respective return conduit of an air supply system of a structure wherein the plurality of tubes are configured for intaking air from the structure through the interior space to the air handler.

11. The plenum of claim 10, further including the second section being directly couplable to the air handler.

12. A supply air plenum comprising:

a shell defining an interior space, the shell comprising:

a first section having a bottom, the bottom being open wherein the first section is configured for coupling to an air handler such that the interior space is in fluidic communication with the air handler, the first section being substantially rectangularly box shaped, and a second section, the second section being coupled to and protruding from a first side of the first section, the second section being hemispherically shaped;

a plurality of tubes coupled to and extending from the second section of the shell wherein each tube is configured for coupling to a respective return conduit of an air supply system of a structure wherein the plurality of tubes are configured for intaking air from the structure through the interior space to the air handler, each tube comprising a plurality of pleats such that the tube is selectively bendable, the plurality of tubes comprising from four to twelve tubes;

a flange coupled to and extending perpendicularly from the bottom of the first section wherein the flange is configured for mating with a corresponding flange on the air handler for coupling the shell to the air handler; and a plate coupled to the first section and positioned in the interior space, the plate extending arcuately between the first side and a second side of the first section such that the plate extends from proximate to the bottom to proximate to a top of the first section wherein the plate is configured for directing the air entering through the plurality of tubes into the interior space through the bottom to the air handler.

* * * * *